US008641017B2

(12) United States Patent
Aasen et al.

(10) Patent No.: US 8,641,017 B2
(45) Date of Patent: Feb. 4, 2014

(54) DEVICE FOR ABSORPTION OF GAS OR VAPOUR IN A LIQUID AND METHOD FOR REINTRODUCING VAPOUR OR GAS IN THE LIQUID FROM WHICH THE GAS OR VAPOUR ORGINATES

(75) Inventors: Helge Aasen, His (NO); Rune Bo, Arendal (NO); Rune Gammelsater, Trondheim (NO)

(73) Assignee: GBA Marine AS, His (NO)

( * ) Notice: Subject to any disclaimer, the term of this patent is extended or adjusted under 35 U.S.C. 154(b) by 684 days.

(21) Appl. No.: 12/159,257

(22) PCT Filed: Jan. 15, 2007

(86) PCT No.: PCT/NO2007/000017

§ 371 (c)(1),
(2), (4) Date: Aug. 26, 2008

(87) PCT Pub. No.: WO2007/086751

PCT Pub. Date: Aug. 2, 2007

(65) Prior Publication Data

US 2009/0306440 A1 Dec. 10, 2009

(30) Foreign Application Priority Data

Jan. 26, 2006 (NO) ..... 20060437

(51) Int. Cl.
*B01F 3/04* (2006.01)

(52) U.S. Cl.
USPC ..... 261/76; 261/79.2

(58) Field of Classification Search
USPC ..... 261/76, 79.2
See application file for complete search history.

(56) References Cited

U.S. PATENT DOCUMENTS

| | | | | |
|---|---|---|---|---|
| 3,761,065 | A * | 9/1973 | Rich et al. | 261/76 |
| 4,514,343 | A * | 4/1985 | Cramer et al. | 261/37 |
| 4,743,405 | A * | 5/1988 | Durao et al. | 261/76 |
| 4,936,552 | A * | 6/1990 | Rothrock | 261/76 |
| 5,004,484 | A * | 4/1991 | Stirling et al. | 95/263 |
| 5,169,293 | A * | 12/1992 | Yamamoto | 417/179 |
| 5,403,522 | A * | 4/1995 | Von Berg | 261/36.1 |
| 5,520,856 | A * | 5/1996 | Garrett et al. | 261/76 |
| 5,951,922 | A * | 9/1999 | Mazzei | 261/36.1 |
| 6,199,834 | B1 * | 3/2001 | Popov et al. | 261/76 |
| 6,237,897 | B1 * | 5/2001 | Marina | 261/64.1 |
| 6,539,884 | B1 * | 4/2003 | Husain et al. | 114/74 R |
| 2002/0079384 | A1 | 6/2002 | Popov | |

FOREIGN PATENT DOCUMENTS

| | | |
|---|---|---|
| GB | 971563 | 9/1964 |
| JP | 63319030 | 12/1988 |
| JP | 06002964 | 1/1994 |
| JP | 2002364600 | 12/2002 |

* cited by examiner

*Primary Examiner* — Charles Bushey
(74) *Attorney, Agent, or Firm* — Ladas & Parry LLP

(57) ABSTRACT

Device for absorption of at least one component chosen among gas and vapor in a liquid based on an ejector principle, comprising a mixing zone in the form of a substantially straight tube (5) immediately downstream of the ejector (1). The device comprises an ejector (1) with central liquid passage (2) and a substantially annular, sectioned aperture (4) for gas/vapor. The gas aperture (4) generally surrounds the central liquid passage (2) and the annular, sectioned aperture (4) for gas/vapor is designed in a manner to cause the gas/vapor to enter the mixing zone with a velocity component that is inclined to the periphery surface of the tube to thereby provide a helical flow (6) downstream of the ejector (1).

8 Claims, 2 Drawing Sheets

DEVICE FOR ABSORPTION OF GAS OR VAPOUR IN A LIQUID AND METHOD FOR REINTRODUCING VAPOUR OR GAS IN THE LIQUID FROM WHICH THE GAS OR VAPOUR ORGINATES

The present invention concerns a device for absorption of at least one component chosen among gas and vapour in a liquid. The device is based on an ejector principle with a mixing zone in the form of a substantially straight tube immediately downstream of the ejector. According to another aspect the invention concerns a method for reintroducing gas or vapour in a liquid.

BACKGROUND

The present invention has a number of application areas. One important application is for transport or storage of volatile and flammable fluids in large tanks such as ship tanks in connection with transport of different types of hydrocarbon containing liquids.

In tanks of the type mentioned vapour and gas of the most volatile components of the liquid, which are also the most flammable components and furthermore toxic, will rapidly form. These gases and vapours will establish equilibrium with the corresponding components in the liquid phase under formation of a certain overpressure in the tank. Generally these types of components are denoted "volatile organic components", VOC. Motion and varying temperature conditions can influence on this process in the direction of a higher pressure. In addition to the economic loss the formed gas represents a safety hazard.

The safety problem is mainly related to oil transport on tank ships. Evaporation of gas from the liquid leads to an increased pressure in the tanks and thus a need for pressure reduction to ensure that the tanks are not damaged. This has commonly been achieved by manually opening a valve which is typically localized mid-ships. Under tough weather conditions this is in itself a safety hazard. There is also a safety risk related to the possibility of too low pressure which may lead to undesired introduction of air into the tanks and a resulting formation of explosive gases therein.

The economic loss is related to the evaporation of components from the liquid, e.g. oil, so that the ship arrives at its destination with less liquid than was loaded.

Many attempts have been made to overcome these problems in different ways that generally can be divided into two categories. The two categories or systems both involve absorption of gas in the liquid for which it has evaporated. First category comprises systems that are arranged on the deck of the tank and is exemplified by Norwegian patent No. 316 045, U.S. Pat. No. 6,786,063 and U.S. Pat. No. 3,003,325. The second category comprises systems that are embedded within the tanks and is exemplified by Norwegian patent No 315 293 and Norwegian patent No. 315 417.

Disadvantages with the known systems are partly that they are less effective than desirable and also they do not avoid all safety risks or other disadvantages.

OBJECTIVES

It is therefore an object of the present invention to provide a device for absorption of gases and vapours that is efficient, inexpensive, eliminates the known risk elements and other disadvantages as mentioned above.

The device should be easy to build, simple to maintain and easy and inexpensive to operate.

It is furthermore a particular object to provide a method for reintroducing in a liquid vapour which has evaporated from the liquid, particularly hydrocarbon containing liquids. It is especially important that the method and the device are suitable for use onboard ships.

THE INVENTION

Said objects are fulfilled in the form of the device according to the present invention as defined by a device for absorption of at least one component, chosen among gas and vapour into a liquid, based on an elector principle and comprising a mixing zone in the form of a substantially straight tube immediately downstream of the ejector, characterized in that the device comprises an ejector with a central liquid passage and a substantially annular, sectioned aperture for gas/vapour, said aperture generally surrounding the central liquid passage, wherein the annular, sectioned aperture for gas/vapour is designed in a manner to cause the gas/vapour to enter the mixing zone with a velocity component that is inclined to the periphery surface of the tube to thereby provide a helical flow) downstream of the ejector.

Preferred embodiments of the invention are disclosed by the dependent claims.

By the term "inclined to the periphery surface" as used herein is understood a direction which is not parallel to the length axis of the tube downstream of the ejector for the components of the flow which at any time is close to the inner surface of the tube. When regarding the flow direction radially inwards from the tube surface to the tube axis, the degree of said inclination of the velocity component is reduced and in centre of the tube the flow direction will, though somewhat turbulent, be mainly parallel to the tube axis.

The device according to the present invention s based on the ejector principle and a vital aspect of the invention is the manner in which the gas is sucked into and mixed with the liquid in the ejector according to the invention, the nozzles or openings for the gas being arranged in an annular aperture that surrounds a central, preferably circular liquid passage, the openings for the gas being directed inclined to the axis of the tube or "mixing chamber" downstream of the ejector. This causes the gas to be introduced into the liquid in a direction that provides a helical flow of gas and liquid at least in the area near the tube wall. This flow contributes to a centrifugal force—or a centripetal acceleration—that affects the heavier components (the liquid) more than the lighter components (gas and vapour) in the mixing zone, with the result that the gas moves towards the centre of the tube while the liquid moves towards the tube wall.

Since the gas is supplied from radially outside the liquid this design ensures an even distribution of gas and liquid in the tube downstream of the ejector, which is the most significant parameter in relation to achieve absorption of the gas n the liquid. An even distribution of the gas reduces the possibility of gas bubbles colliding with other gas bubbles to form larger bubbles which would negatively affect absorption.

Below the method of the invention is explained more in detail in relation to transport of oil and other hydrocarbon containing liquids on a ship.

It is convenient to arrange the device according to the present invention outside the liquid tank in question to allow maintenance and replacement of worn parts without having to empty the tank.

It is furthermore convenient that the system is arranged laterally outside such a tank rather, at a level lower than the liquid level in the tank, than on the deck of the tank. Thereby a long arrangement of tubes with circulating oil and gas in an external environment over deck is avoided with the safety hazard thereby involved. More typically the device according to the present invention can be localized to a pump room or the like which is well protected and suitably ventilated.

The present invention can be combined with other technologies such as a back-pressure valve in the main outlet conduit. A particular advantage with this combination is the fact that the efficiency of the system is increased when liquid is loaded/filled on the tank, by ensuring a constant pressure under varying gas/liquid conditions in the tanks.

FIGURE DESCRIPTION

Figure 1:
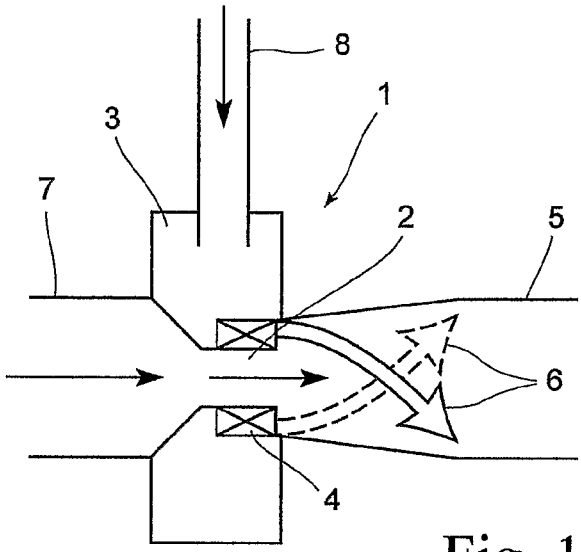
FIG. 1 is a simple side sectional view of an ejector according to the present invention.

FIG. 1 shows a rotational ejector 1 according to the present invention with a central quid passage 2 surrounded by a substantially ring shaped collar 3 that constitutes the gas inlet opening of the ejector and comprises a substantially annular aperture 4 for the gas, said aperture 4 preferably being sectioned so that it may be referred to as apertures (plural form). The aperture or aperture 4 typically constitute more than half the periphery delimiting the liquid passage 2 and ay preferably surround the entire periphery of the liquid passage 2 with the exception of walls or plates (not shown) that divides the aperture 4 in sections. The sections of the aperture 4 are isolated from each other by walls or plates which are inclined in relation to the length axis of the tube 5 downstream of the ejector 1, with an inclination that is common for all sections when view along the periphery of the passage 2, so that gas passing through the various sections of the aperture thereby induces a helical flow path in the liquid as indicated by the arrows 6. The area downstream of the ejector, i.e. within the tube 5, is referred to as the ejector mixing zone.

As also shown by FIG. 1 liquid is fed to the ejector through a conduit 7 while gas is fed to the ejector through a conduit 8 that ends in the annular collar 3.

Figure 2:
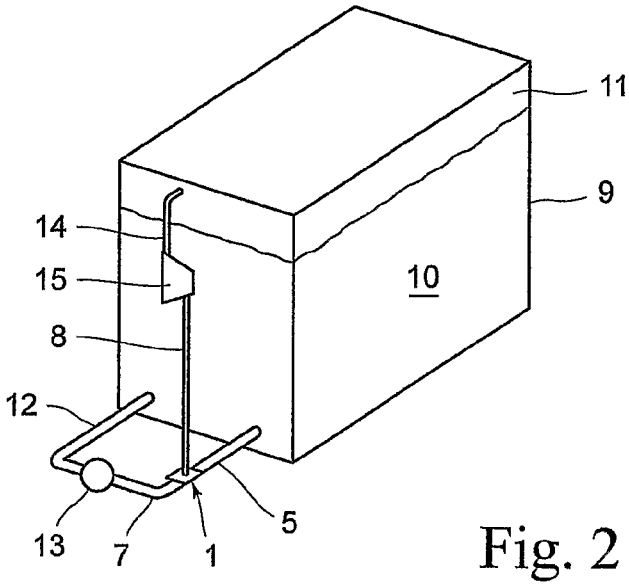
FIG. 2 is a perspective drawing showing a device according to the present invention by the side of a liquid tank.

FIG. 2 shows the ejector 1 according to the invention in connection with a tank 9 for a liquid 10 like oil. Over the liquid 10 in the tank 9 volatile components of the liquid 10 form a gas 11. Near the bottom of the tank 9 a liquid loop comprising a conduit 12, a liquid pump 13, a conduit 7, the ejector 1 and a conduit 5 which also enters the tank 9, are arranged. In addition a conduit 14 is connected near the top of the tank 9 where the gas is to lead the gas via a pump 15 and a conduit 8 to the gas inlet of the ejector 1. By means of the ejector 1, gas from the space above the liquid level in the tank 9 is again mixed with and absorbed in the liquid 10 so that the pressure development in the tank 9 is held under control and so that loss of liquid is reduced.

Figure 3:
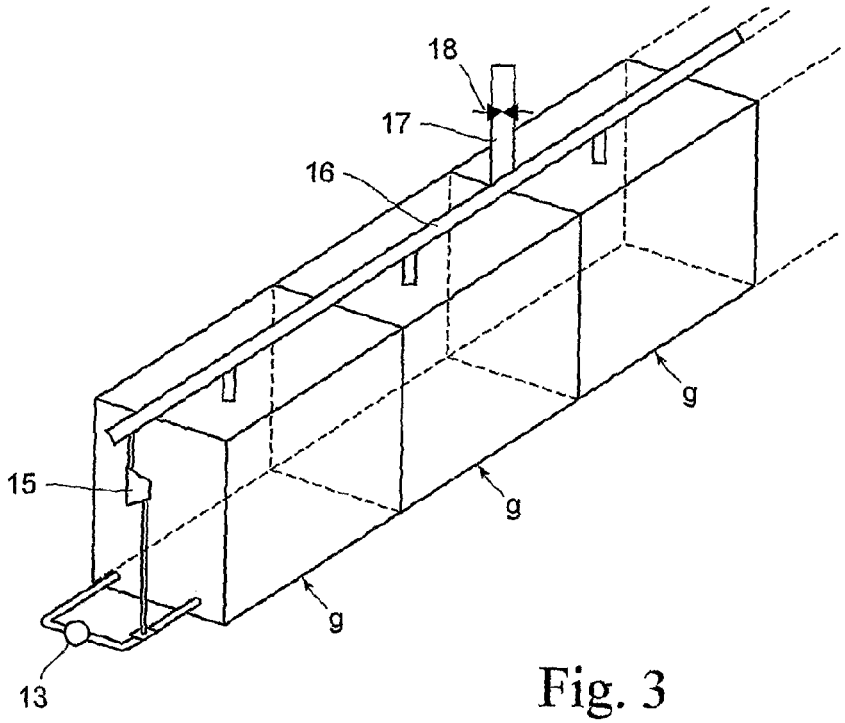
FIG. 3 is a perspective drawing showing the position of a device according to the invention used in connection with a series of tanks arranged in a row.

FIG. 3 generally shows the same as FIG. 2 but in a constellation of several tanks 9 in a row one behind the other. A main gas pipe 16 or a network of gas pipes connected to each of the tanks is connected to the ejector 1 via the pump 15 in this embodiment. Though not shown in the Figure, there may be liquid communication between the tanks to distribute the absorbed gas to more than one tank.

FIG. 3 furthermore shows a gas main outlet conduit 317 provided with a pressure controlled valve 18. This is a valve which adjusts the pressure during loading and holds the pressure comparatively high so that gas is absorbed without use of the system. When the loading of gas is completed the present system should be used so that gas absorbed during loading can be reabsorbed subsequent evaporation during transport. The valve also has a function with respect to safety regarding excessive pressure in the tanks.

Though the tanks shown in FIG. 3 are arranged in a row one behind the other, it is to be understood that the tanks as well may be arranged in two or more rows or in other configurations and need not even be arranged at a common vertical level.

Figure 4:
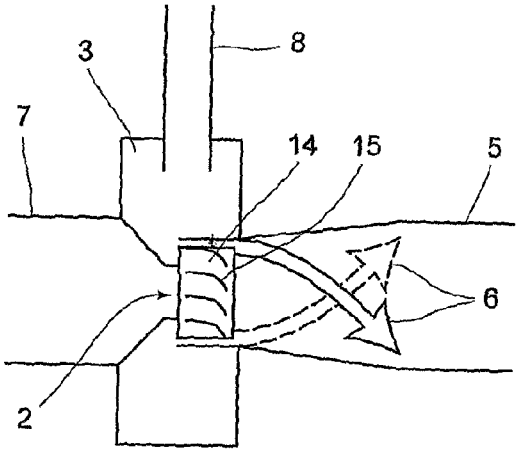
FIG. 4 is a partial side sectional view of a variant of the ejector shown in FIG. 1.

FIG. 4 shows a variant of the ejector shown in FIG. 1. The aperture or apertures 4 for the gas inlet are in this embodiment restricted inwards by the outer surface of an open wheel 14 or a corresponding ring shaped member having curved vanes or baffles 15 on its outer surface. The wheel 14 has somewhat smaller diameter than the diameter of the tube 5 in which the wheel is arranged while the radial extension of said vanes substantially take up the reminder part of the tube 5 diameter. It is to be understood that the wheel 14 does not need to rotate since the curved shape of the vanes sets the passing gas into rotation. The wheel 14 or the ring shaped member has a central opening and surrounds the liquid passage 2.

The vanes shown in FIG. 4 are at their respective leading edges mainly parallel with the tube 5 axis (and tube 7 axis). This is preferred but not required. Near the trailing edges the vanes 15 are at an angle to said axis that preferably is in the range from 3 to 60 degrees and more preferred from 10 to 30 degrees.

Vanes or baffles which are not curved can also be used, i.e. flat baffles or vanes with a fixed angle to the tube 5 axis from their leading edges to trailing edges. Whether flat or curved vanes or baffles are used it is preferred that they are substantially parallel when regarded along the periphery in an arbitrary cross-section perpendicular to the axis of the wheel 14 (as if the wheel periphery was folded out to a flat surface).

FIGS. 1 and 4 show an ejector where it is apparent that there is a reduction in cross-section area from tube 7 into the ejector and also a certain increase in cross-section from the ejector into tube 5. The exact geometry of the ejector according to the present invention is, however, not critical.

It is preferred with the device of the present invention that there is a compressor arranged to the supply line to the ejector for vapour or gas to more efficiently and controllably feed the ejector with vapour or gas.

In addition to an efficient absorption the installation of a system according to the FIGS. 2-3 provides a significant advantage compared to systems used at present. The installation of the system in the pump room means that liquid need not be pumped to the tank deck which represents a significant reduces risk in using the system and also that any leakage will only occur in the pump room which has a safety design and "clearance" to handle leakages.

The system is in principle maintenance free but can be furnished with a self-cleaning system for handling liquids that contain large amounts of sediments. Since the system is maintenance free one can also choose to install the system within the tank(s) if the geometric design of the tanks should be in favour of such an installation. For large amounts of gas ejectors can be assembled in parallel, e.g. within a separate container holding for example 5 to 10 ejectors. With such an assembly the system can be scaled to handle practically any amounts of gas.

The figures show tanks of rectangular shape. This is not mandatory with the device according to the present invention and the tanks can have any given shape. For example the ejector can be connected directly to the inlet conduit of conventional absorption towers and thus contribute to an increase in efficiency of such equipment.

The invention claimed is:

1. Device for absorption of at least one component chosen among gas and vapour into a liquid, based on an ejector principle and comprising a mixing zone in the form of a substantially straight tube immediately downstream of the ejector, characterized in that the device comprises an ejector (1) with a converging central liquid passage for providing the liquid to the ejector (2) and a substantially annular, sectioned aperture (4) for gas/vapour configured to allow the gas/vapour to be sucked into the ejector due to the motive force of the fluid, said aperture (4) generally surrounding the central liquid passage (2), wherein the annular, sectioned aperture (4) for gas/vapour is designed in a manner to cause the gas/vapour to enter the mixing zone with a velocity component that is inclined to the periphery surface of the tube to thereby provide a helical flow (6) downstream of the ejector (1) wherein the liquid is the sole motive fluid for the device.

2. Device as claimed in claim 1, characterized in that the sectioned aperture for gas comprises baffles (15) which when viewed along the periphery of the ejector tube (5) are substantially parallel with each other so that all parts of the gas sucked into the ejector will have a velocity generally at a common inclined angle in relation to the tube (5) axis.

3. Device as claimed in claim 2, characterized in that the baffles (15) are arranged on the outer surface of a substantially ring shaped member (14) that surrounds the liquid passage (2).

4. Device as claimed in claim 2, characterized in that the angle between a baffle and the tube axis is in the range 3 to 60 degrees.

5. Device as claimed in claim 4, characterized in that said angle is in the range 10 to 30 degrees.

6. Device as claimed in claim 1, characterized in that a compressor is arranged on the flow feed line for vapour to the ejector.

7. Device as claimed in claim 1, characterized in that the device is part of a system for reintroducing liquid vapour from the volume over a liquid in a tank on a transport ship, the ejector being connected to and constitutes a part of a closed loop of circulating liquid of the tank while vapour from the volume over the liquid inside the tank is fed to the ejector gas/vapour inlet.

8. Device as claimed in claim 7, characterized in that a back-pressure valve is arranged in a gas main outlet conduit.

* * * * *